US006961965B2

(12) United States Patent
Chiang

(10) Patent No.: US 6,961,965 B2
(45) **Date of Patent: *Nov. 8, 2005**

(54) SWIMMING GOGGLES

(76) Inventor: Herman Chiang, 11F-2 No. 634-9 Ching-Ping RD., Chung-Ho City, Taipei Hsien (TW)

( * ) Notice: Subject to any disclaimer, the term of this patent is extended or adjusted under 35 U.S.C. 154(b) by 251 days.

This patent is subject to a terminal disclaimer.

(21) Appl. No.: 10/420,852

(22) Filed: Apr. 23, 2003

(65) Prior Publication Data

US 2004/0210991 A1 Oct. 28, 2004

(51) Int. Cl.[7] ..... A61F 9/02
(52) U.S. Cl. ..... 2/445; 2/452
(58) Field of Search ..... 2/428, 430, 452, 2/426, 440; 24/170, 163 R, 265 R, 265 BC

(56) References Cited

U.S. PATENT DOCUMENTS 6,276,794 B1 * 8/2001 Chiang ..... 351/43
6,349,419 B1 * 2/2002 Chiang ..... 2/428
6,691,378 B1 * 2/2004 Chou ..... 24/170
6,832,394 B1 * 12/2004 Chiang ..... 2/428

* cited by examiner

*Primary Examiner*—Katherine M. Moran
(74) *Attorney, Agent, or Firm*—Troxell Law Office, PLLC

(57) ABSTRACT

A pair of swimming goggles, includes left and right goggle frames, a connection bridge connected between the left and right goggle frames, a pair of buckles respectively attached to the left and right goggle frames opposite the connection bridge, and a head strap adjustably fastened to the buckles. Each goggle frame has outer and inner surfaces. A receiving hole is defined between the outer and inner surfaces of each goggle frame and receives a lens therein. Each buckle includes a base and a cover attached to the base. A chamber is cooperatively defined in the base and the cover and receives a shaft and a fastener therein. An entrance is defined between the base and the shaft. An exit is defined between the shaft and the cover. The fastener is adjacent to the shaft and includes a handle and an engagement protrusion. Each of free ends of the head strap extends into the entrance of the buckle, extends out of the exit of the buckle and abuts against the shaft. Each free end of the head strap selectively engages with the engagement protrusion of the buckle thereby fixing the head strap to the buckle. The handle is rotatable to disengage the engagement protrusion from the head strap whereby wearing length of the head strap is adjustable through moving the free ends of the head strap relative to the shaft.

16 Claims, 7 Drawing Sheets

SWIMMING GOGGLES

BACKGROUND OF THE INVENTION

1. Field of the Invention

The present invention relates to a pair of swimming goggles, and particularly to swimming goggles having buckles for adjusting wearing length of a head strap thereof directly when the swimming goggles are worn.

2. Related Art

Swimming goggles are worn with a head strap thereof being fastened to a user's head. The head strap is usually adjustable to be tight or loose to the user's head thereby making the user comfortable. Referring to FIG. 1, conventional swimming goggles 7 include a head strap 70 and two buckles 71 at opposite sides thereof Each buckle 71 defines two slots 710, 711 therein Each of opposite free ends 701, 702 of the head strap 70 extends through the two slots 710, 711 of each buckle 71 in turn and then is wound at the buckle 71 thereby connecting the head strap 70 to the buckles 71. The connection between the head strap 70 and the buckles 71 is adjustable through one or both of the free ends 701, 702 of the head strap 70 sliding along the slots 710, 711 of the buckles 71. Thus, the head strap 70 is adjustable to fasten the swimming goggles 7 to the user.

However, the swimming goggles 7 must be taken off before the adjustment of the head strap 70. Then the swimming goggles 7 are worn again after the adjustment of the head strap 70. It is hard to fit the swimming goggles 7 to the user though once of the adjustment. In fact, it often need several times of adjustment to fittingly wear the swimming goggles 7. So, the user has to wear and take off the swimming goggles 7 several times. Even so, the user may still feel uncomfortable to wear the swimming goggles 7. It is inconvenient to adjust the swimming goggles 7.

SUMMARY OF THE INVENTION

Accordingly, an object of the present invention is to provide a pair of swimming goggles which is ready to adjust wearing length of a head strap thereof for being fit to a user, and which does not need to be taken off during the adjustment.

To achieve the above-mentioned object, a pair of swimming goggles in accordance with the present invention includes left and right goggle frames, a connection bridge connected between the left and right goggle frames, a pair of buckles respectively attached to the left and right goggle frames opposite the connection bridge, and a head strap adjustably fastened to the buckles. Each goggle frame has outer and inner surfaces. A receiving hole is defined between the outer and inner surfaces of each goggle frame and receives a lens therein. Each buckle includes a base and a cover attached to the base. A chamber is cooperatively defined in the base and the cover and receives a shaft and a fastener therein. An entrance is defined between the base and the shaft. An exit is defined between the shaft and the cover. The fastener is adjacent to the shaft and includes a handle and an engagement protrusion. Each of free ends of the head strap extends into the entrance of the buckle, extends out of the exit of the buckle and abuts against the shaft. Each free end of the head strap selectively engages with the engagement protrusion of the buckle thereby fixing the head strap to the buckle. The handle is rotatable to disengage the engagement protrusion from the head strap whereby wearing length of the head strap is adjustable through moving the free ends of the head strap relative to the shaft.

Other objects, advantages and novel features of the present invention will be drawn from the following detailed embodiment of the present invention with attached drawings, in which:

DESCRIPTION OF THE PREFERRED EMBODIMENTS

Figure 1:
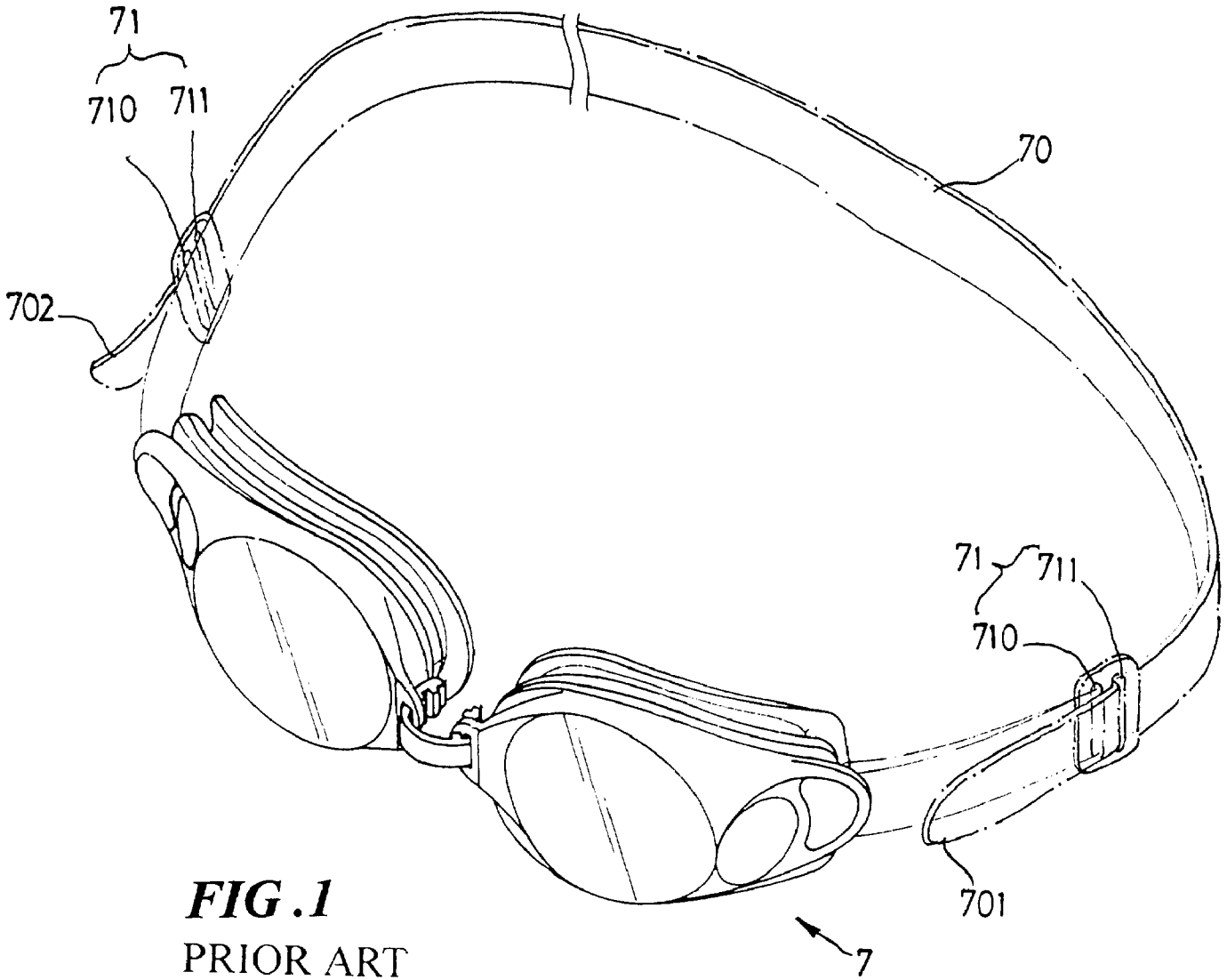
FIG.1 PRIOR ART
FIG. 1 is a perspective view of conventional swimming goggles.
Figure 2:
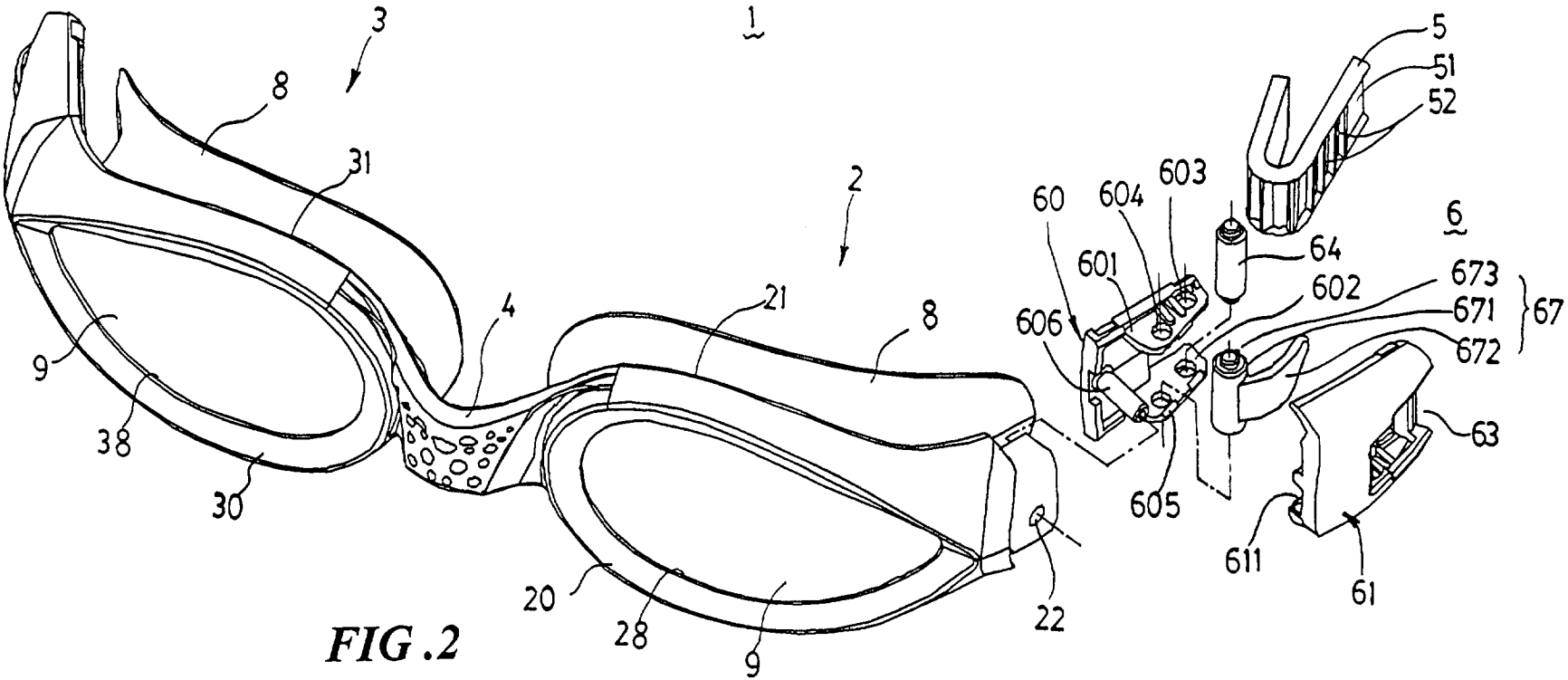
FIG. 2 is an exploded view of a pair of swimming goggles of the present invention.
Figure 3:
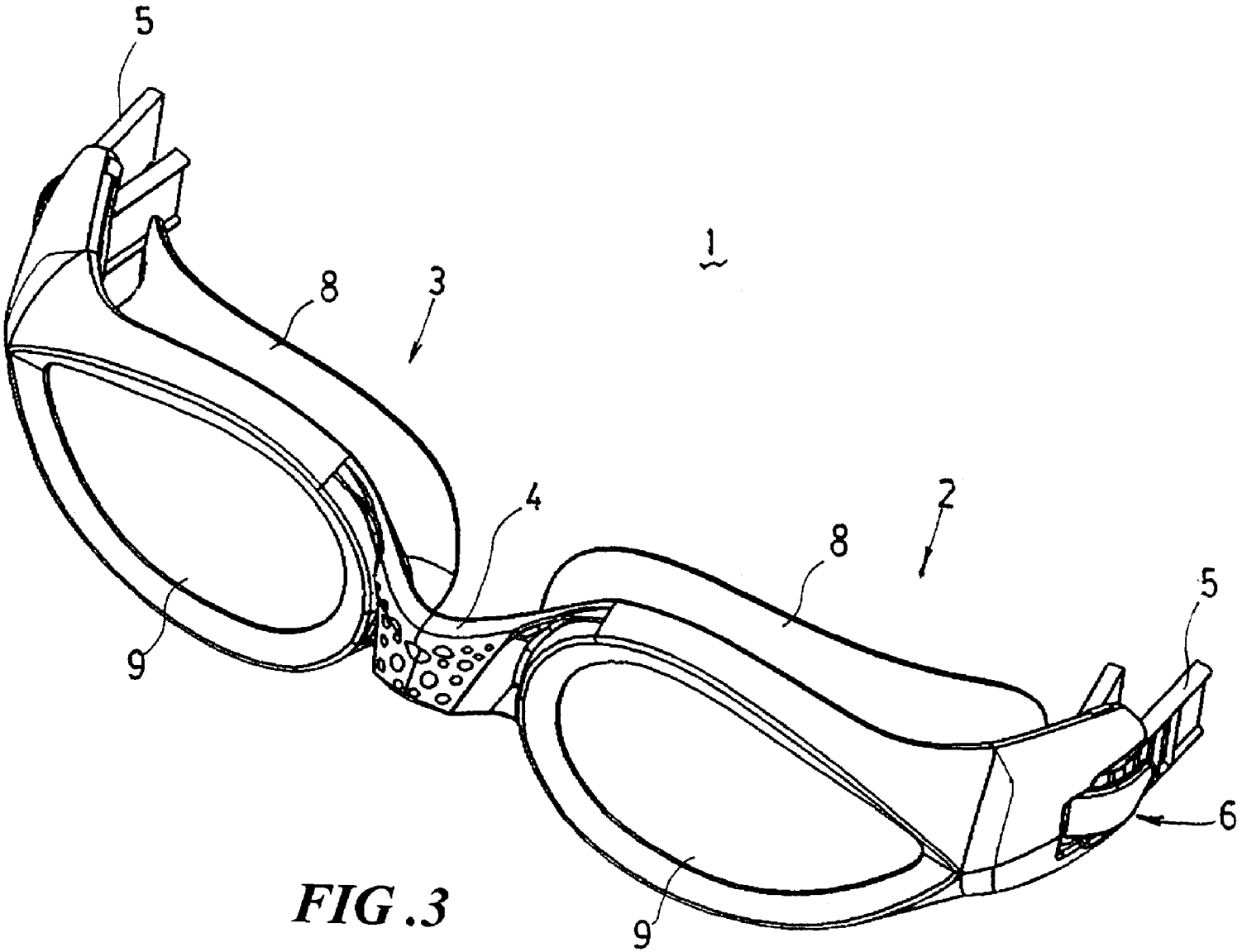
FIG. 3 is an assembled view of FIG. 2.
Figure 6:
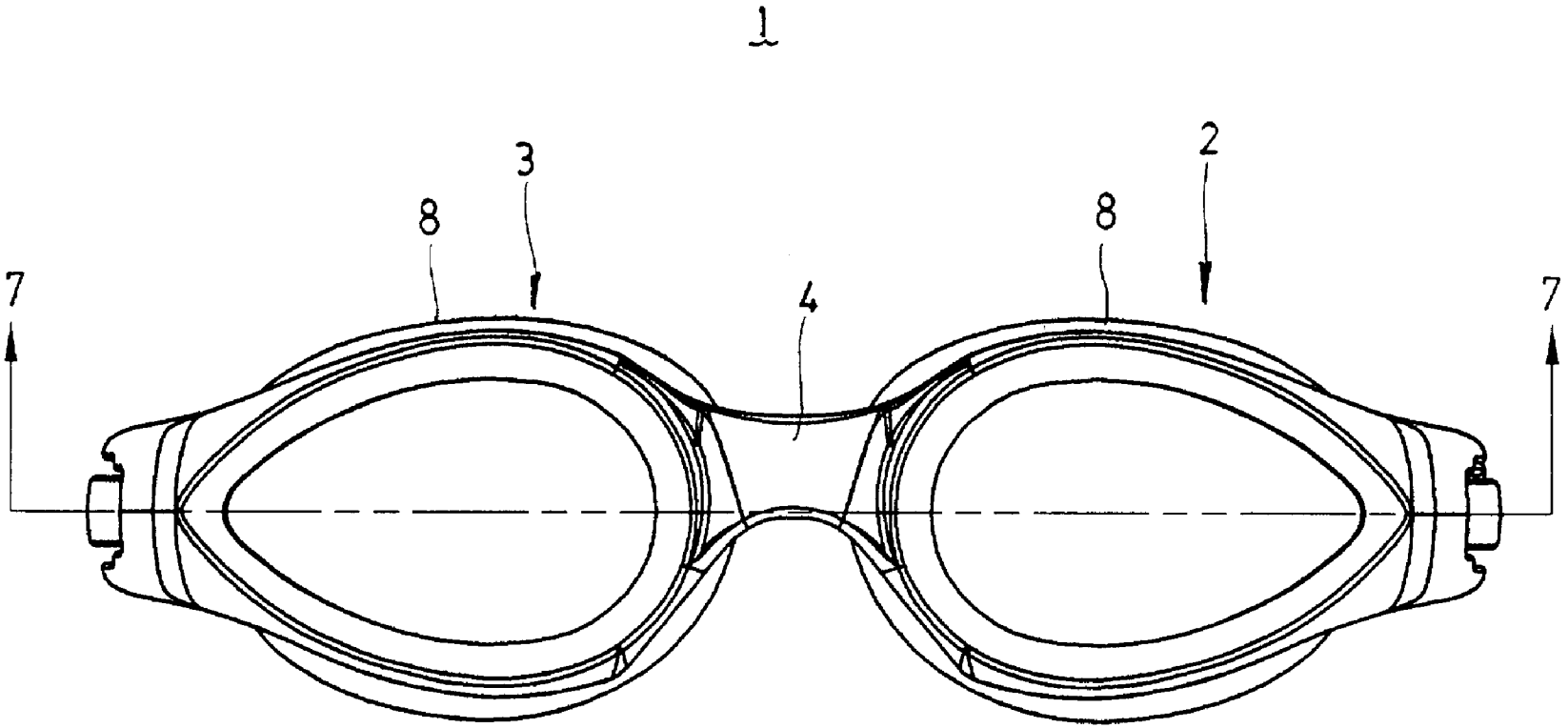
FIG. 6 is a front elevational view of FIG. 3 without the head strap.

Referring to FIGS. 2, 3 and 6, a pair of swimming goggles 1 of the present invention includes a left goggle frame 2, a right goggle frame 3, a connection bridge 4, a head strap 5, and a pair of adjustable buckles 6. Each of the left and right goggle frames 2, 3 has an outer surface 20, 30 and an inner surface 21, 31. A pair of receiving holes 28, 38 are defined between the outer surfaces 20, 30 and the inner surfaces 21, 31 and receive lenses 9 therein, respectively. A pair of protection pads 8 are integrally formed at the inner surfaces 21, 31 of the left and right goggle frames 2, 3 for comfortable contact with a user's face. The connection bridge 4 is connected between the left and right goggle frame 2, 3. The left and right goggle frames 2, 3 are similarly configured. For easy illustration, only the left goggle frame 2 is exploded, as shown in FIG. 2. A mounting hole 22 is defined at a side portion of the left goggle frame 2 opposite the connection bridge 4.

Each buckle 6 includes a base 60, a fastener 67 and a cover 61. The base 60 includes an upper wall 601 substantially perpendicularly extending from an upper portion thereof, and a lower wall 602 substantially perpendicularly extending from a lower portion thereof. A pair of shaft holes 603 and axial holes 604 are defined in the upper and lower walls 601, 602, respectively. A shaft 64 is rotatably assembled between the upper and lower wall 601, 602 with end portions thereof received in the shaft holes 603. A pair of recesses 605 is defined in the upper and lower walls 601, 602. A post 606 extends from the base 60 for engagingly extending into the mounting hole 22 of the left goggle frame 2 thereby fixing the buckle 6 to the left goggle frame 2.

The fastener 67 includes an axial portion 671, a handle 672 extending from the axial portion 671 and an engagement protrusion 673 extending from the axial portion 671 opposite the handle 672. The fastener 67 is rotatably assembled between the upper and lower walls 601, 602 with end portions of the axial portion 671 received in the axial holes 604. The handle 672 is generally arc-shaped. The engagement protrusion 673 is generally barb-shaped. The axial portion 671 is parallel and adjacent to the shaft 64.

The cover 61 includes a pair of fixing protrusions 611 for snappingly engaging with the recesses 605 of the base 60 thereby fixing the cover 61 to the base 60. A chamber 63 is cooperatively defined in the base 60 and the cover 61 for receiving the shaft 64 and the fastener 67 therein. Also referring to FIG. 7, an entrance 65 is defined between the shaft 64 and the base 60 for extension of a free end 51 of the head strap 5. An exit 66 is defined between the shaft 64 and the cover 61 for extension of the free end 51 of the head strap 5. The arc-shaped handle 672 is depressable each of the free ends 50, 51 of the head strap 5 to close a user's head. A number of engagement slots 52 are defined in each free end 50, 51 of the head strap 5 for selectively engaging with the engagement protrusion 673 of the fastener 67 thereby fixing the head strap 5 to the buckle 6.

Figure 7:
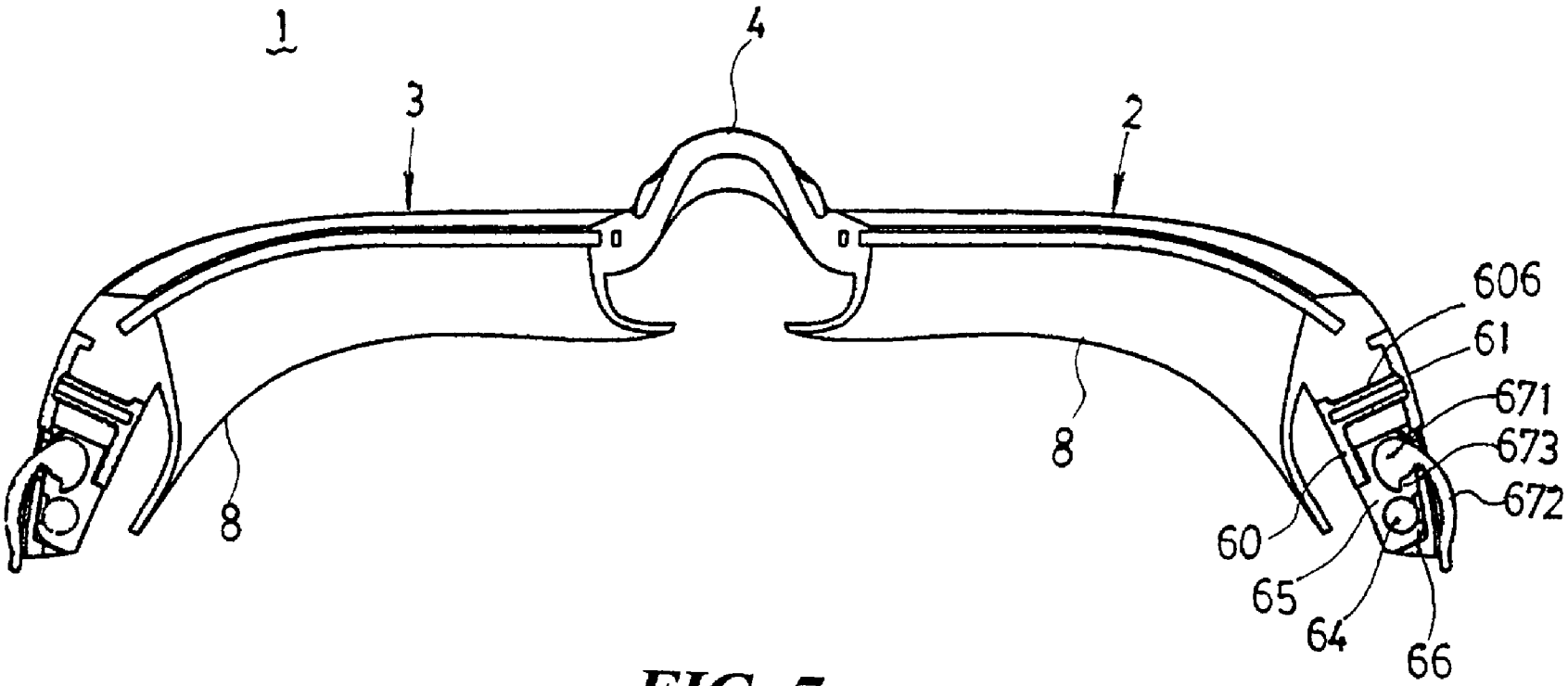
FIG. 7 is a cross-sectional view taken along line 7—7 in FIG. 6.

Referring to FIGS. 2 and 7, in assembly of the buckle 6, the shaft 64 and the fastener 67 are rotatably coupled to the shaft holes 603 and the axial holes 604 of the base 60. The post 606 is received in the mounting hole 22 of the left goggle frame 2. The cover 61 is attached to the base 60 with the fixing protrusions 611 thereof engaging with the recesses 605 of the base 60. Thus, the buckle 6 is assembled to the left goggle frame 2. Likewise, the other buckle 6 is assembled to the right goggle frame 3.

Figure 8:
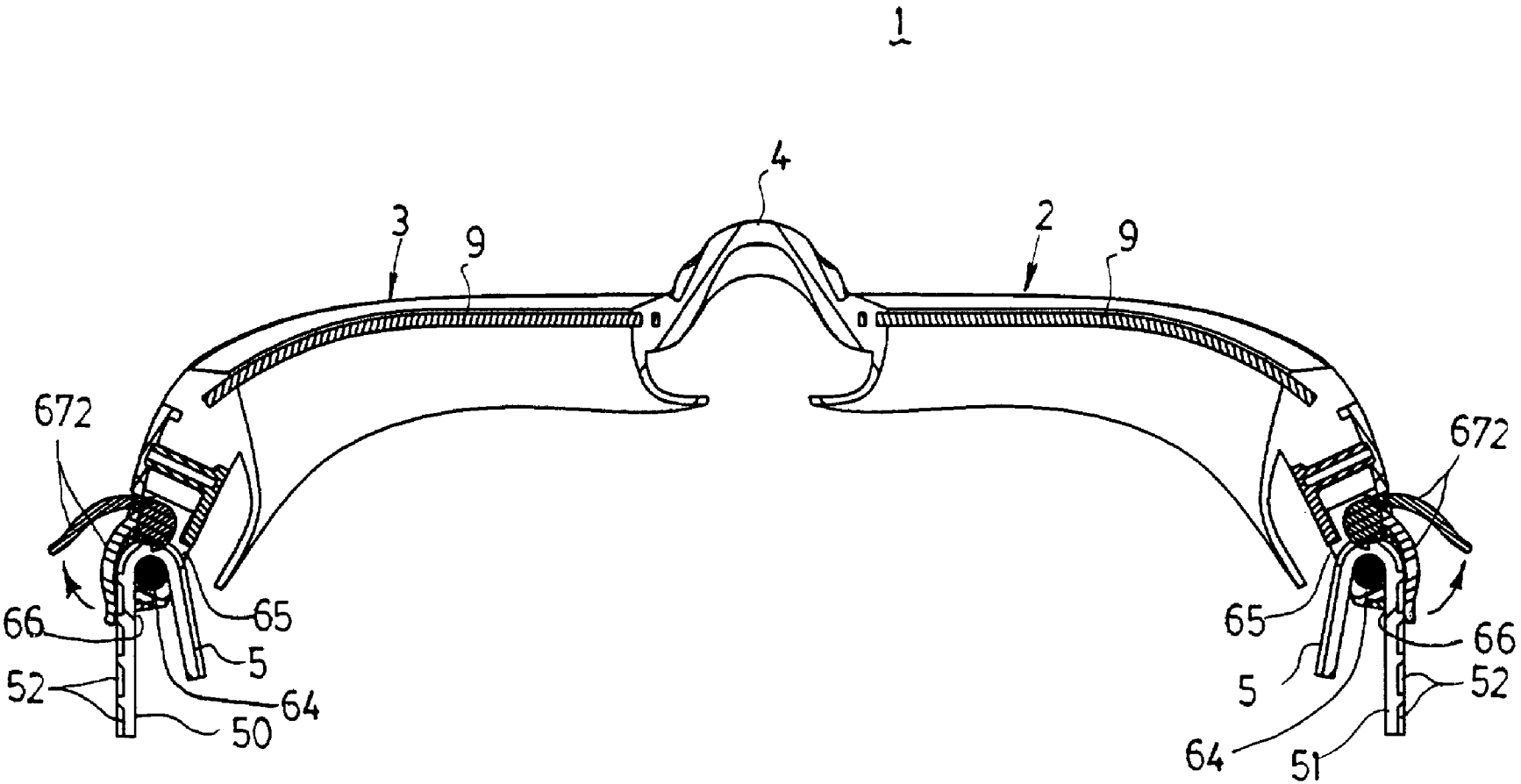
FIG. 8 is similar to FIG. 7 but having the head strap.

Also referring to FIG. 8, the free ends 50, 51 of the head strap 5 respectively extend into the entrances 65 of the buckles 6, extend out from the exits 66 of the buckles 6 and abut against the shafts 64. One of the engagement slots 52 of each free end 50, 51 of the head strap 5 engages with the engagement portion 673 of the fastener 67. Thus, the head strap 5 is assembled to the buckles 6.

Figure 4:
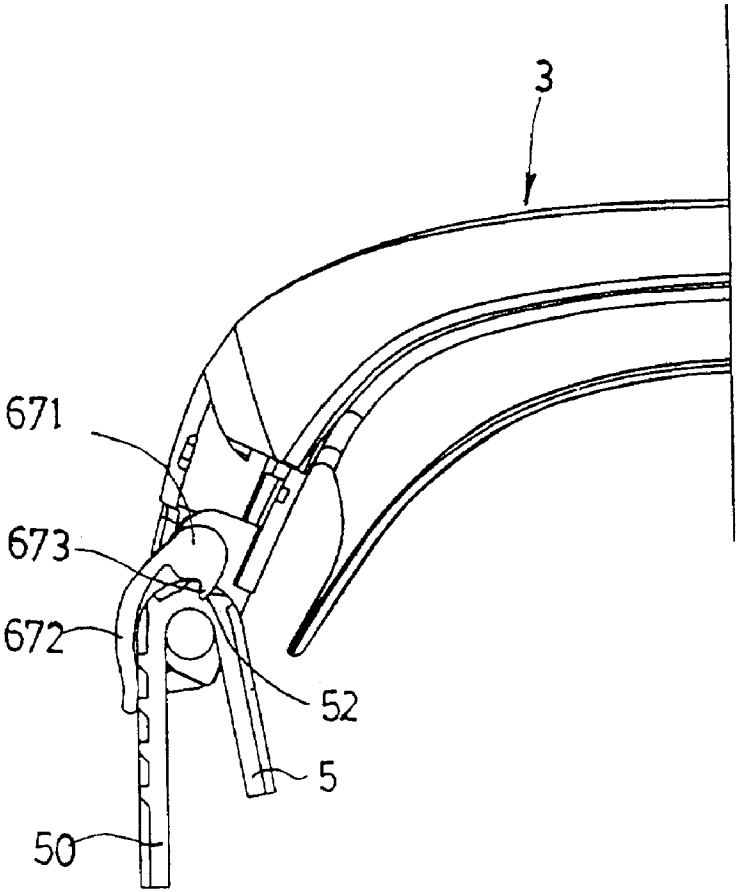
FIG. 4 is a cross-sectional view of half of the swimming goggles.
Figure 5:
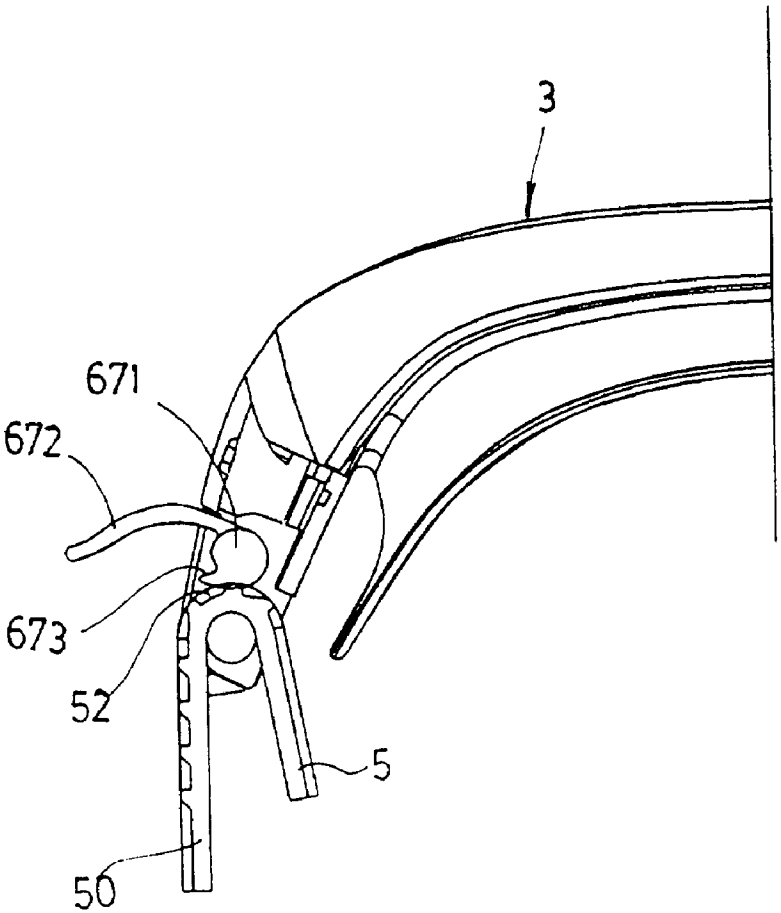
FIG. 5 is similar to FIG. 4 but showing a fastener disengaging from a head strap.

FIGS. 4 and 5 show adjustment operation of wearing length of the head strap 5. Referring to FIG. 4, the handle 672 of the fastener 67 is depressed to be received in the chamber 63 and presses the free end 50 of the head strap 5 to close a user's head. The engagement protrusion 673 of the fastener 67 receivingly engages with one of the engagement slots 52 of the head strap 5. Thus, the head strap 5 is securely fixed to the buckle 6. Referring to FIG. 5, the handle 672 of the fastener 67 is pushed to rotate the axial portion 671 of the fastener 67. The engagement protrusion 673 of the fastener 67 disengages from the engagement slot 52 of the head strap 5. The free end 50 is movable relative to the shaft 64, thereby adjusting the wearing length of the head strap 5 to meet size requirement of a user.

Also referring to FIG. 8, the handle 672 is pushed outward to move the free ends 50, 51 of the head strap 5 relative to the shaft 64. When the head strap 5 is fit to a user, the handle 672 is depressed inward to fix the head strap 5 to the buckles 67. Thus, the swimming goggles 1 can be directly adjusted to meet size requirement of a user, when worn by the user. Furthermore, the swimming goggles 1 can be fittingly worn though once of adjustment. Therefore, it is convenient to use the swimming goggles 1 of the present invention.

It is understood that the invention may be embodied in other forms without departing from the spirit thereof. Thus, the present example and embodiment are to be considered in all respects as illustrative and not restrictive, and the invention is not to be limited to the details given herein.

What is claimed is:

1. A pair of swimming goggles, comprising:

left and right goggle frames, each goggle frame having outer and inner surfaces, a receiving hole being defined between the outer and inner surfaces of each goggle frame and receiving a lens therein;

a connection bridge connected between the left and right goggle frames;

a pair of buckles respectively attached to the left and right goggle frames opposite the connection bridge; and a head strap adjustably fastened to buckles; and wherein each buckle including a base and a cover attached to the base, a chamber being cooperatively defined in the base and the cover, said chamber receiving a shaft and a fastener therein, an entrance being defined between the base and the shaft, an exit being defined between the shaft and the cover, the fastener being adjacent to the shaft and including a handle and a engagement protrusion.

2. The swimming goggles as claimed in claim 1, wherein the base includes upper and lower walls, a pair of shaft holes and axial holes are defined in the upper and lower walls respectively, the shaft is rotatable about the shaft holes, and the fastener is rotatable about the axial holes.

3. The swimming goggles as claimed in claim 2, wherein the fastener further includes an axial portion, wherein the handle extends from the axial portion, and wherein the engagement protrusion extends from the axial portion and is substantially barb-shaped.

4. The swimming goggles as claimed in claim 3, wherein the handle is substantially arc-shaped for selectively adjusting the head strap.

5. The swimming goggles as claimed in claim 2, wherein a pair of recesses is defined in the upper and lower walls of the base, a pair of fixing protrusions is formed at the cover and engages with the recesses of the base thereby fixing the cover to the base.

6. The swimming goggles as claimed in claim 2, wherein a post is formed at the base of the buckle, a mounting hole is defined in each of the goggle frame opposite the connection bridge and receives the post therein thereby fixing the buckle to the goggle frame.

7. The swimming goggles as claimed in claim 1, wherein a pair of protection pads is integrally formed at the inner surfaces of the left and right goggle frames.

8. The swimming goggles as claimed in claim 1, wherein a plurality of engagement slots is defined in each of the free ends of the head strap, each of the engagement slots receivingly engages with the engagement protrusion of the buckle thereby fixing the head strap to the buckle.

9. A pair of swimming goggles, comprising:

left and right goggle frames, each goggle frame having outer and inner surfaces, a receiving hole being defined between the outer and inner surfaces of each goggle frame and receiving a lens therein;

a connection bridge being integrally formed with the left and right goggle frame;

at least one buckle attached to at least one of the left and right goggle frames opposite the connection bridge; and a head strap adjustably fastened to the buckles; and wherein each buckle including a base and a cover attached to the base, a chamber being cooperatively defined in the base and the cover and receiving a fastener therein, the fastener including a handle and an engagement protrusion.

10. The swimming goggles as claimed in claim 9, wherein the base includes upper and lower walls, a pair of shaft holes and axial holes are defined in the upper and lower walls respectively, a shaft is received between the upper and lower walls and rotatable about the shaft holes, and the fastener is adjacent to the shaft and rotatable about the axial holes.

11. The swimming goggles as claimed in claim 10, wherein an entrance is defined between the base and the shaft of the buckle, an exit is defined between the shaft and the cover of the buckle, at least one free end of the head strap extends into the entrance of the buckle, extends out of the exit of the buckle and abuts against the shaft.

12. The swimming goggles as claimed in claim 9, wherein the fastener further includes an axial portion, wherein the handle extends from the axial portion and is substantially arc-shaped, and wherein the engagement protrusion extends from the axial portion and is substantially barb-shaped.

13. The swimming goggles as claimed in claim 10, wherein a pair of recesses is defined in the upper and lower walls of the base and a pair of fixing protrusions is formed at the cover and engages with the recesses of the base thereby fixing the cover to the base.

14. The swimming goggles as claimed in claim 10, wherein a post is formed at the base of the buckle, a mounting hole is defined in the at least one of the goggle frames opposite the connection bridge and receives the post therein thereby fixing the buckle to the goggle frame.

15. The swimming goggles as claimed in claim 9, wherein a pair of protection pads is integrally formed at the inner surfaces of the left and right goggle frames.

16. The swimming goggles as claimed in claim 9, wherein a plurality of engagement slots are defined in each of two free ends of the head strap, each of the engagement slots receivingly engages with the engagement protrusion of the buckle thereby fixing the head strap to the buckle.

* * * * *